US008801428B2

(12) United States Patent
Melton et al.

(10) Patent No.: US 8,801,428 B2
(45) Date of Patent: Aug. 12, 2014

(54) COMBUSTOR AND METHOD FOR SUPPLYING FUEL TO A COMBUSTOR

(75) Inventors: Patrick Benedict Melton, Horse Shoe, NC (US); Willy Steve Ziminsky, Simpsonville, SC (US); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 563 days.

(21) Appl. No.: 13/252,279

(22) Filed: Oct. 4, 2011

(65) Prior Publication Data

US 2013/0084534 A1 Apr. 4, 2013

(51) Int. Cl.

| | |
|---|---|
| ***F02C 1/00*** | (2006.01) |
| ***F23R 3/10*** | (2006.01) |
| ***F23R 3/28*** | (2006.01) |
| ***F23R 3/46*** | (2006.01) |
| ***F23R 3/34*** | (2006.01) |
| ***F23D 14/62*** | (2006.01) |

(52) U.S. Cl.

CPC . *F23R 3/343* (2013.01); *F23R 3/10* (2013.01); *F23R 3/286* (2013.01); *F23R 3/46* (2013.01); *F23R 2900/03343* (2013.01); *F23D 14/62* (2013.01)

USPC ..... 431/2; 431/187; 431/328; 60/737; 60/723; 60/772

(58) Field of Classification Search

USPC ..... 431/2, 187, 10, 328; 60/737, 723, 772

See application file for complete search history.

(56) References Cited

U.S. PATENT DOCUMENTS

| | | | | |
|---|---|---|---|---|
| 3,695,818 | A * | 10/1972 | Mizutani | 431/328 |
| 3,771,500 | A | 11/1973 | Shakiba | |
| 4,104,873 | A | 8/1978 | Coffinberry | |
| 4,412,414 | A | 11/1983 | Novick et al. | |
| 5,104,310 | A | 4/1992 | Saltin | |
| 5,186,620 | A * | 2/1993 | Hollingshead | 431/354 |
| 5,205,120 | A | 4/1993 | Obländer et al. | |
| 5,213,494 | A | 5/1993 | Jeppesen | |
| 5,341,645 | A | 8/1994 | Ansart et al. | |
| 5,439,532 | A | 8/1995 | Fraas | |
| 5,592,819 | A | 1/1997 | Ansart et al. | |
| 5,707,591 | A | 1/1998 | Semedard et al. | |

(Continued)

OTHER PUBLICATIONS

Co-pending and commonly assigned U.S. Appl. No. 12/499,777, filed Jul. 8, 2009.

(Continued)

*Primary Examiner* — Steven B McAllister
*Assistant Examiner* — Nikhil Mashruwala
(74) *Attorney, Agent, or Firm* — Dority & Manning, PA

(57) ABSTRACT

A combustor includes an end cap having upstream and downstream surfaces and a cap shield surrounding the upstream and downstream surfaces. First and second sets of premixer tubes extend from the upstream surface through the downstream surface. A first fuel conduit supplies fuel to the first set of premixer tubes. A casing circumferentially surrounds the cap shield to define an annular passage, and a second fuel conduit supplies fuel through the annular passage to the second set of premixer tubes. A method for supplying fuel to a combustor includes flowing a working fluid through first and second sets of premixer tubes, flowing a first fuel into the first set of premixer tubes, and flowing a second fuel through an annular passage surrounding the end cap and into the second set of premixer tubes.

16 Claims, 6 Drawing Sheets

(56) References Cited

U.S. PATENT DOCUMENTS

| | | | | |
|---|---|---|---|---|
| 5,957,682 | A * | 9/1999 | Kamal et al. | 431/328 |
| 6,098,407 | A | 8/2000 | Korzendorfer et al. | |
| 6,123,542 | A | 9/2000 | Joshi et al. | |
| 6,394,791 | B2 | 5/2002 | Smith et al. | |
| 6,438,961 | B2 | 8/2002 | Tuthill et al. | |
| 6,636,058 | B2 * | 10/2003 | Lyford | 324/756.04 |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 * | 3/2006 | Dinu | 60/737 |
| 7,631,499 | B2 | 12/2009 | Bland | |
| 7,752,850 | B2 | 7/2010 | Laster et al. | |
| 7,975,489 | B2 * | 7/2011 | Joshi et al. | 60/777 |
| 2004/0216463 | A1 | 11/2004 | Harris | |
| 2008/0016876 | A1 | 1/2008 | Colibaba-Evulet et al. | |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 * | 1/2011 | Kraemer et al. | 60/772 |
| 2011/0072824 | A1 | 3/2011 | Zuo et al. | |
| 2011/0073684 | A1 * | 3/2011 | Johnson et al. | 239/553.5 |
| 2011/0076628 | A1 * | 3/2011 | Miura et al. | 431/12 |
| 2011/0083439 | A1 | 4/2011 | Zuo et al. | |
| 2011/0089266 | A1 | 4/2011 | Stoia et al. | |

OTHER PUBLICATIONS

Co-pending and commonly assigned U.S. Appl. No. 12/877,385, filed Sep. 8, 2010.

Co-pending and commonly assigned U.S. Appl. No. 12/877,399, filed Sep. 8, 2010.

Co-pending and commonly assigned U.S. Appl. No. 13/020,156, filed Feb. 3, 2011.

Co-pending and commonly assigned U.S. Appl. No. 13/213,460, filed Aug. 19, 2011.

Co-pending and commonly assigned U.S. Appl. No. 13/244,526, filed Sep. 25, 2011.

* cited by examiner

COMBUSTOR AND METHOD FOR SUPPLYING FUEL TO A COMBUSTOR

FIELD OF THE INVENTION

The present invention generally involves a combustor and method for supplying fuel to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, localized hot streaks in the combustion chamber may increase the disassociation rate of diatomic nitrogen, increasing the production of nitrogen oxides ($NO_X$) at higher combustion gas temperatures. Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, a plurality of premixer tubes may be radially arranged in an end cap to provide fluid communication for the working fluid and fuel flowing through the end cap and into the combustion chamber. The premixer tubes enhance mixing between the working fluid and fuel to reduce hot streaks that can be problematic with higher combustion gas temperatures. As a result, the premixer tubes are effective at preventing flashback or flame holding and/or reducing $NO_X$ production, particularly at higher operating levels. However, an improved system and method for supplying fuel to the premixer tubes that allows for staged fueling or operation of the premixer tubes at varying operational levels would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap that extends radially across at least a portion of the combustor. The end cap includes an upstream surface axially separated from a downstream surface and a cap shield circumferentially surrounding the upstream and downstream surfaces. A first set of premixer tubes extend from the upstream surface through the downstream surface to provide fluid communication through the end cap. A first fuel conduit in fluid communication with the first set of premixer tubes supplies fuel to the first set of premixer tubes. A second set of premixer tubes extend from the upstream surface through the downstream surface to provide fluid communication through the end cap. A casing circumferentially surrounds at least a portion of the cap shield to define an annular passage between the cap shield and the casing. A second fuel conduit in fluid communication with the second set of premixer tubes supplies fuel through the annular passage to the second set of premixer tubes.

Another embodiment of the present invention is a combustor that includes an end cap that extends radially across at least a portion of the combustor. The end cap comprises an upstream surface axially separated from a downstream surface and a cap shield circumferentially surrounding the upstream and downstream surfaces. A first fuel conduit is in fluid communication with the end cap. A first set of premixer tubes extend from the upstream surface through the downstream surface to provide fluid communication through the end cap. A second set of premixer tubes extend from the upstream surface through the downstream surface to provide fluid communication through the end cap. A casing circumferentially surrounds at least a portion of the end cap to define an annular passage between the end cap and the casing. A second fuel conduit in fluid communication with the second set of premixer tubes supplies fuel through the annular passage to the second set of premixer tubes.

The present invention may also include a method for supplying fuel to a combustor. The method includes flowing a working fluid through a first set of premixer tubes that extend axially through an end cap that extends radially across at least a portion of the combustor and flowing the working fluid through a second set of premixer tubes that extend axially through the end cap. The method further includes flowing a first fuel into the first set of premixer tubes and flowing a second fuel through an annular passage surrounding the end cap and into the second set of premixer tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
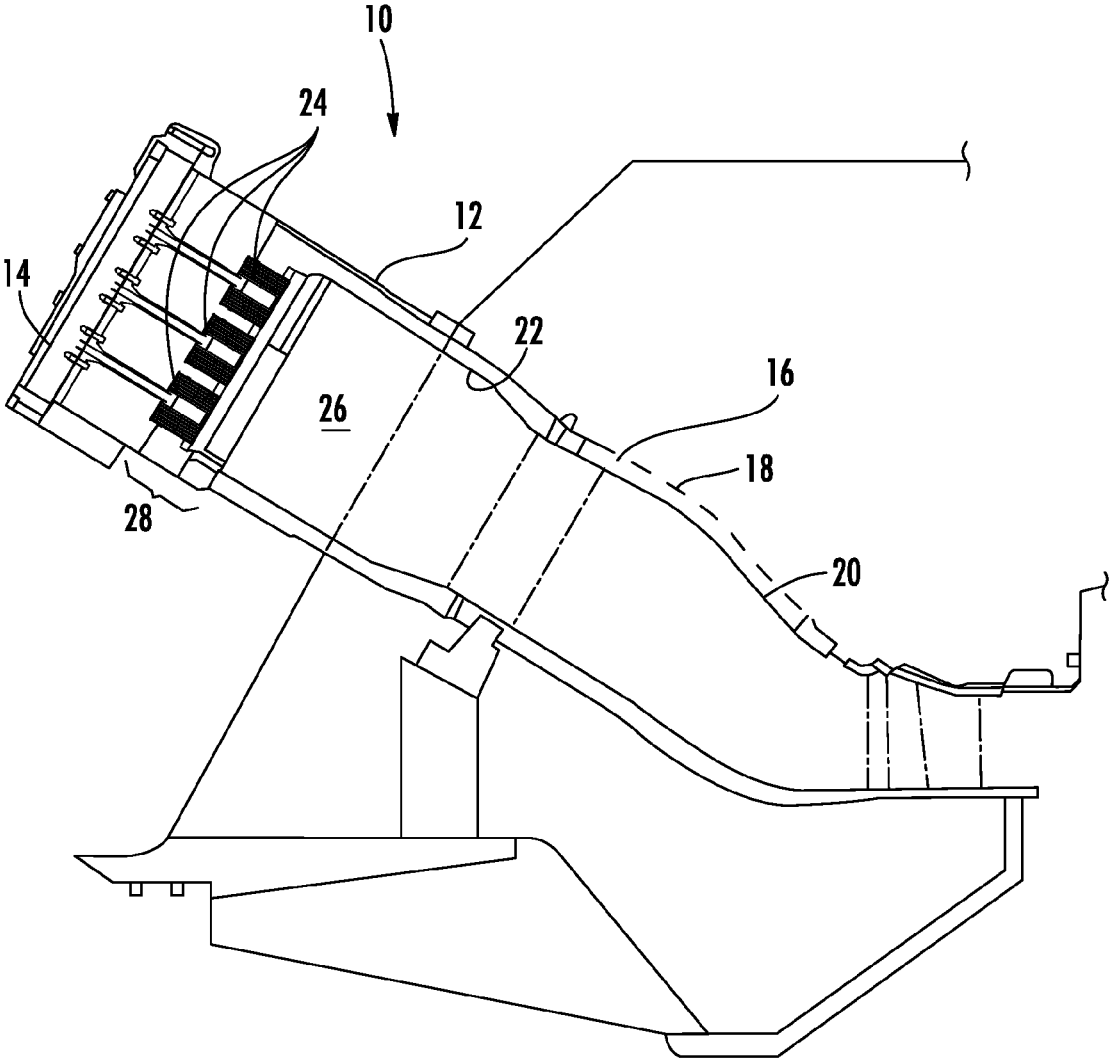
FIG. 1 is a simplified cross-section view of an exemplary combustor according to a first embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a system and method for supplying fuel to a combustor. In particular embodiments, a plurality of premixer tubes arranged in an end cap enhance mixing between a working fluid and fuel prior to combustion. The fuel may be supplied to the premixer tubes through one or more axial and/or radial fuel conduits. In this manner, the premixer tubes may be grouped into multiple fuel circuits that enable the combustor to be operated over a wide range of operating conditions without exceeding design margins associated with flashback, flame holding, and/or emissions limits. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section view of an exemplary combustor 10, such as would be included in a gas turbine, according to one embodiment of the present invention. A casing 12 and an end cover 14 may surround the combustor 10 to contain a working fluid flowing to the combustor 10. The working fluid may pass through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through a plurality of premixer tubes 24 into a combustion chamber 26.

Figure 2:
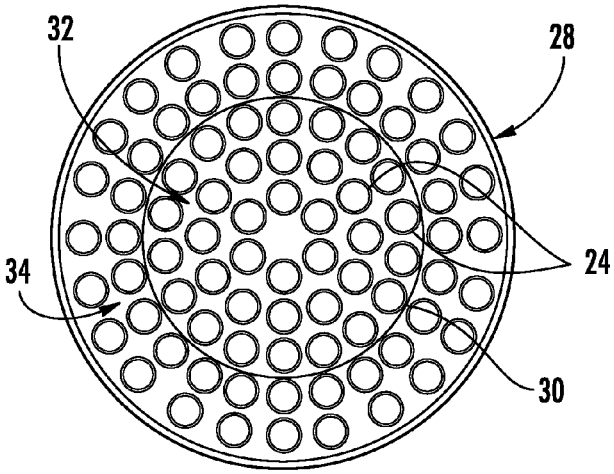
FIG. 2 is an upstream axial view of the end cap shown in FIG. 1 according to an embodiment of the present invention.
Figure 3:
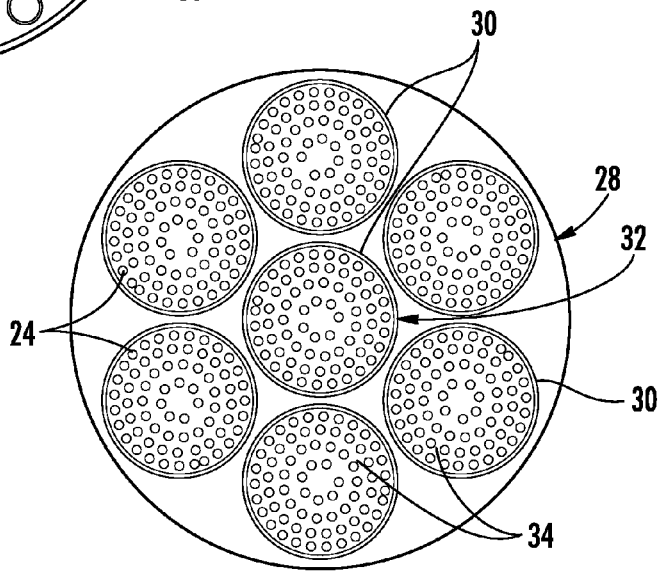
FIG. 3 is an upstream axial view of the end cap shown in FIG. 1 according to an alternate embodiment of the present invention.
Figure 4:
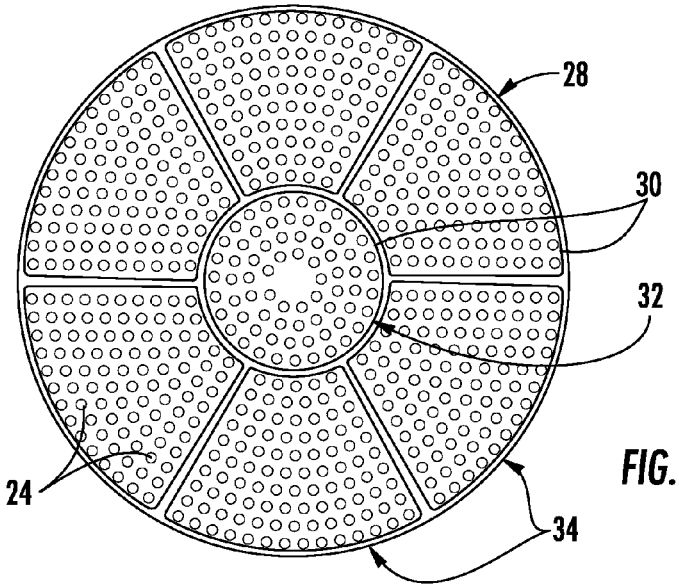
FIG. 4 is an upstream axial view of the end cap shown in FIG. 1 according to an alternate embodiment of the present invention.

The premixer tubes 24 are radially arranged in an end cap 28 upstream from the combustion chamber 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A. Various embodiments of the combustor 10 may include different numbers and arrangements of premixer tubes 24 separated or grouped into various sets across the end cap 28. As shown in FIG. 2, for example, a generally axial baffle 30 may separate the premixer tubes 24 into a first set 32 of premixer tubes 24 circumferentially surrounded by a second set 34 of premixer tubes 24. Alternately, as shown in FIGS. 3 and 4, multiple baffles 30 may separate the premixer tubes 24 into circular, triangular, square, oval, or virtually any shape of sets, and the sets may be arranged in various geometries in the end cap 28. For example, as shown in FIG. 3, six sets 34 of premixer tubes 24 may be radially arranged around a single set 32 of premixer tubes 24. Alternately, as shown in FIG. 4, multiple sets 34 of premixer tubes 24 may be arranged as a series of pie-shaped groups surrounding a circular set 32 of premixer tubes 24. As used herein, the terms "first", "second", and "third" may be used interchangeably to distinguish one component from another and are not intended to signify location or importance of the individual components.

Figure 5:
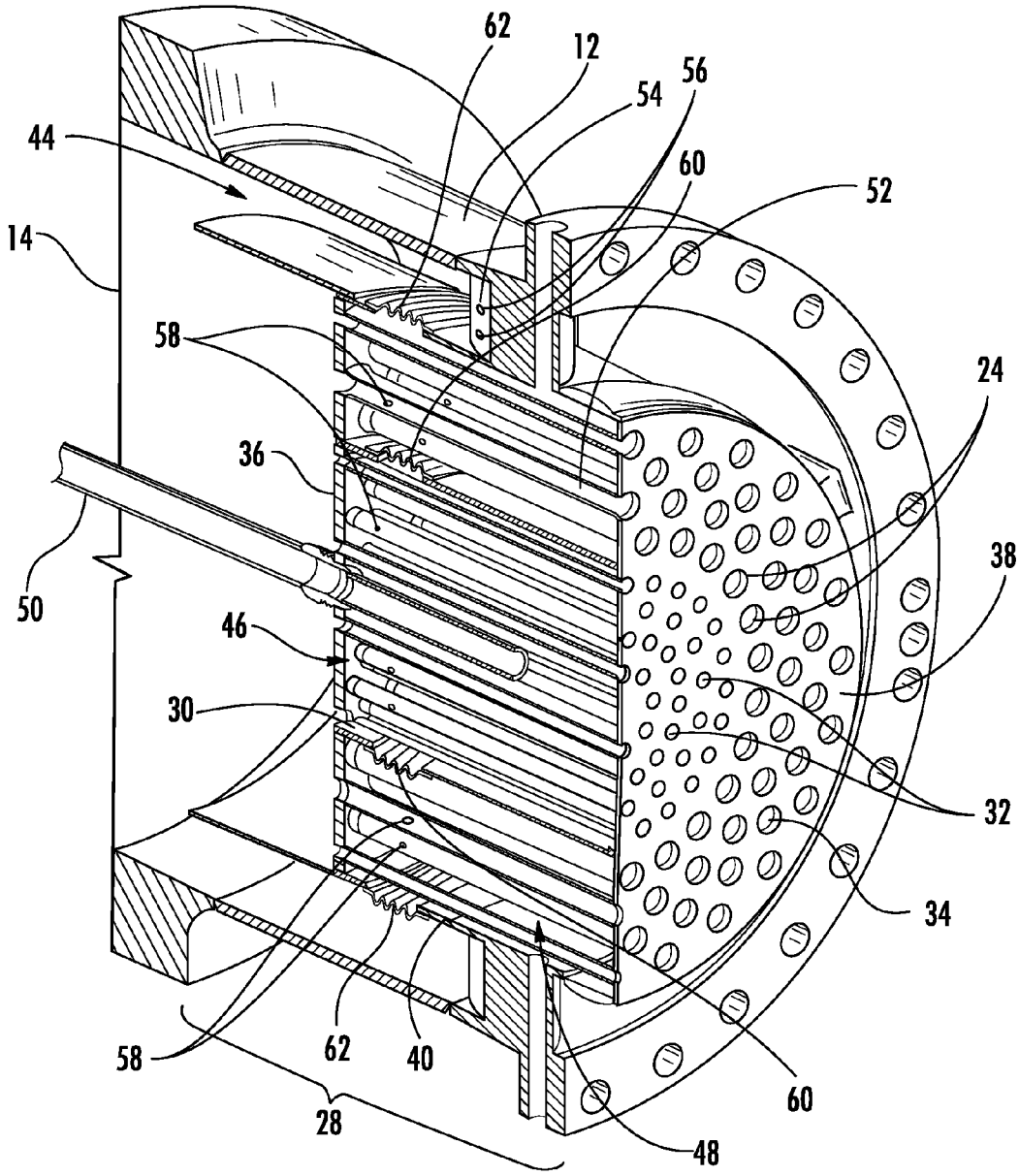
FIG. 5 is an upstream partial perspective view of the end cap shown in FIG. 1 according to a first embodiment of the present invention.

FIG. 5 provides an upstream partial perspective view of the end cap 28 shown in FIG. 1 according to a first embodiment of the present invention. As shown, the end cap 28 generally extends radially across at least a portion of the combustor 10 and includes an upstream surface 36 axially separated from a downstream surface 38. Each premixer tube 24 extends from the upstream surface 36 through the downstream surface 38 of the end cap 28 to provide fluid communication for the working fluid to flow through the end cap 28 and into the combustion chamber 26. Although shown as cylindrical tubes in each embodiment, the cross-section of the premixer tubes 24 may be any geometric shape, and the present invention is not limited to any particular cross-section unless specifically recited in the claims. A cap shield 40 circumferentially surrounds the upstream and downstream surfaces 36, 38 to define a fuel plenum 46, 48 between the upstream and downstream surfaces 36, 38. The casing 12 circumferentially surrounds at least a portion of the cap shield 40 to define an annular passage 44 between the cap shield 40 or end cap 28 and the casing 12.

In the particular embodiment shown in FIG. 5, the axial baffle 30 separates the first set 32 of premixer tubes 24 from the second set 34 of premixer tubes 24 so that the second set 34 of premixer tubes 24 surrounds the first set 32 of premixer tubes 24. In doing so, the axial baffle 30 also separates the fuel plenum into a first fuel plenum 46 surrounding the first set 32 of premixer tubes 24 and a second fuel plenum 48 surrounding the second set 34 of premixer tubes 24. A first fuel conduit 50 may extend axially from the end cover 14 to provide fluid communication through the end cover 14 to the first fuel plenum 46, and a second fuel conduit 52 may extend radially through the casing 12, annular passage 44, and cap shield 40 to provide fluid communication through the casing 12, annular passage 44, and cap shield 40 to the second fuel plenum 48. As shown in FIG. 5, at least one of an airfoil 54 or vane may surround at least a portion of the second fuel conduit 52 in the annular passage 44 to reduce flow resistance of the working fluid flowing across the second fuel conduit 52 in the annular passage 44. In particular embodiments, the airfoil 54 or vane may be angled to impart swirl to the working fluid flowing through the annular passage 44. Alternately, or in addition, the airfoil 54 or vane may include one or more quaternary fuel ports 56 that provide fluid communication from the second fuel conduit 52 through the airfoil 54 or vane and into the annular passage 44. In this manner, the first fuel conduit 50 may supply fuel to the first fuel plenum 46, and the second fuel conduit 52 may supply the same or a different fuel to the second fuel plenum 48 and/or the annular passage 44.

One or more of the premixer tubes 24 in each set may include a fuel port 58 that provides fluid communication through the premixer tubes 24 from the associated fuel plenum 46, 48. The fuel ports 58 may be angled radially, axially, and/or azimuthally to project and/or impart swirl to the fuel flowing through the fuel ports 58 and into the premixer tubes 24. In this manner, the working fluid may flow outside the end cap 28 through the annular passage 44 until it reaches the end cover 14 and reverses direction to flow through the first and second sets 32, 34 of premixer tubes 24. In addition, fuel from the first fuel conduit 50 may flow around the first set 32 of premixer tubes 24 in the first fuel plenum 46 to provide convective cooling to the premixer tubes 24 before flowing through the fuel ports 58 and into the first set 32 of premixer tubes 24 to mix with the working fluid. Similarly, fuel from the second fuel conduit 52 may flow around the second set 34 of premixer tubes 24 to provide convective cooling to the second set 34 of premixer tubes 24 before flowing through the fuel ports 58 and into the second set 34 of premixer tubes 24 to mix with the working fluid. The fuel-working fluid mixture from each set 32, 34 of premixer tubes 24 may then flow into the combustion chamber 26.

The temperature of the fuel and working fluid flowing around and through the premixer tubes 24 may vary considerably during combustor 10 operations. As a result, the end cap 28 may further include one or more expansion joints or bellows between the upstream and downstream surfaces 36, 38 to allow for thermal expansion of the premixer tubes 24 between the upstream and downstream surfaces 36, 38. For example, as shown in FIG. 5, an expansion joint 60 in the baffle 30 may allow for axial displacement of the upstream and downstream surfaces 36, 38 as the first set 32 of premixer tubes 24 expands and contracts. Similarly, an expansion joint 62 in the cap shield 40 may allow for axial displacement of the upstream and downstream surfaces 36, 38 as the second set 34 of premixer tubes 24 expands and contracts. One of ordinary skill in the art will readily appreciate that alternate locations and/or combinations of expansion joints between the upstream and downstream surfaces 36, 38 are within the scope of various embodiments of the present invention, and the specific location or number of expansion joints is not a limitation of the present invention unless specifically recited in the claims.

Figure 6:
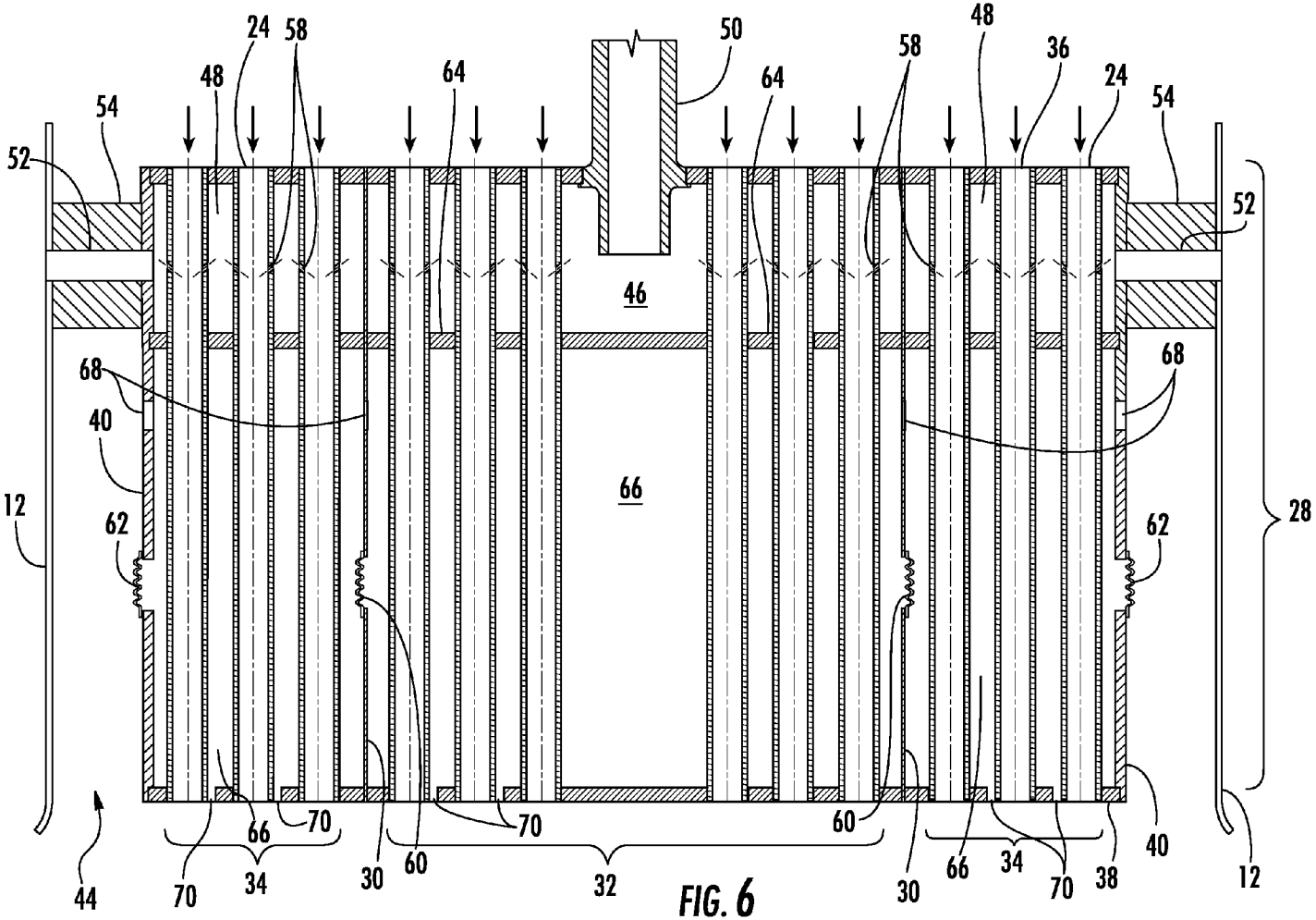
FIG. 6 is an enlarged cross-section view of the end cap shown in FIG. 1 according to a second embodiment of the present invention.

FIG. 6 provides an enlarged cross-section view of the end cap 28 shown in FIG. 1 according to a second embodiment of the present invention. As shown, the end cap 28 again includes the baffle 30, first and second sets 32, 34 of premixer tubes 24, upstream and downstream surfaces 36, 38, cap shield 40, annular passage 44, first and second fuel plenums 46, 48, first and second fuel conduits 50, 52, airfoil 54, fuel ports 58, and expansion joints 60, 62 as previously described with respect to the embodiment shown in FIG. 5. In this particular embodiment, the end cap 28 further includes a barrier 64 that extends generally radially between the upstream and downstream surfaces 36, 38 so that the barrier 64 at least partially defines an air plenum 66 inside the end cap 28. Specifically, the baffle 30, upstream surface 36, cap shield 40, and barrier 64 define the first and second fuel plenums 46, 48, and the downstream surface 38, cap shield 40, and barrier 64 define the air plenum 66 downstream of the first and second fuel plenums 46, 48. One or more air ports 68 through the cap shield 40 and/or baffle 30 may provide fluid communication from the annular passage 44, through the cap shield 40, and into the air plenum 66. In this manner, at least a portion of the working fluid may flow from the annular passage 44 into the air plenum 66 to flow around the first and/or second sets 32, 34 of premixer tubes 24 to provide convective cooling to the premixer tubes 24. The working fluid may then flow through gaps 70 between the downstream surface 38 and the premixer tubes 24 before flowing into the combustion chamber 26.

Figure 7:
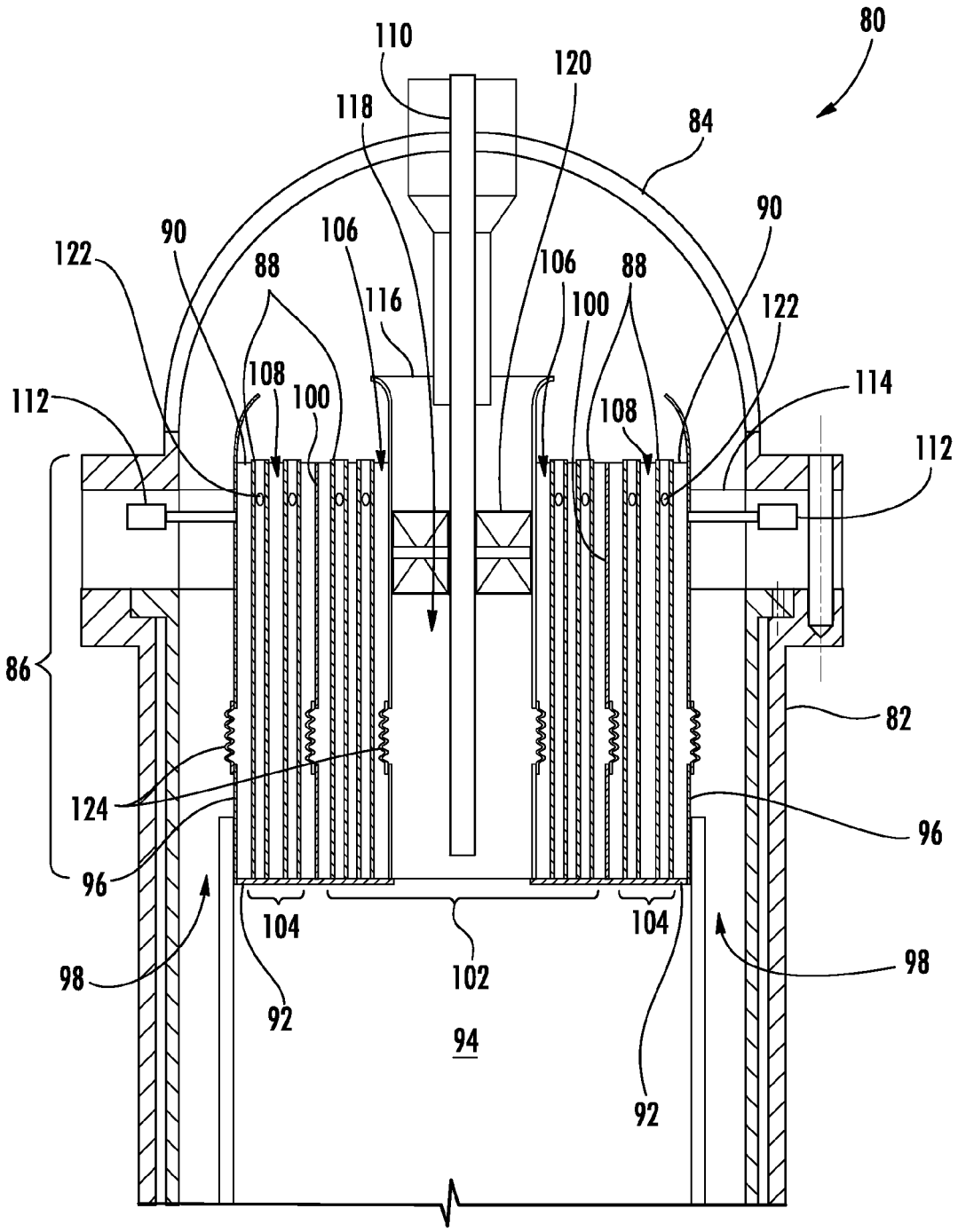
FIG. 7 is an enlarged cross-section view of an exemplary combustor according to a third embodiment of the present invention.

FIG. 7 provides an enlarged cross-section view of an exemplary combustor 80 according to a third embodiment of the present invention. A casing 82 and an end cover 84 may again surround the combustor 80 to contain a working fluid flowing to the combustor 80. The working fluid may again flow outside of an end cap 86 before reaching the end cover 84 and reversing direction to flow through a plurality of premixer tubes 88 radially arranged in the end cap 86. As in the previous embodiments, each premixer tube 88 extends from an upstream surface 90 through a downstream surface 92 to provide fluid communication for the working fluid to flow through the end cap 86 and into a combustion chamber 94. In addition, a cap shield 96 circumferentially surrounds the upstream and downstream surfaces 90, 92 to define a fuel plenum between the upstream and downstream surfaces 90, 92, and the casing 82 circumferentially surrounds at least a portion of the cap shield 96 to define an annular passage 98 between the cap shield 96 or end cap 86 and the casing 82.

An axial baffle 100 again separates a first set 102 of premixer tubes 88 from a second set 104 of premixer tubes 88 so that the second set 104 of premixer tubes 88 surrounds the first set 102 of premixer tubes 88. In doing so, the axial baffle 100 also separates the fuel plenum into a first fuel plenum 106 surrounding the first set 102 of premixer tubes 88 and a second fuel plenum 108 surrounding the second set 104 of premixer tubes 88. A first fuel conduit 110 may extend axially from the end cover 84 to provide fluid communication through the end cover 84 to the end cap 86, and a second fuel conduit 112 may extend radially through the casing 82, annular passage 98, and cap shield 96 to provide fluid communication through the casing 82, annular passage 98, and cap shield 96 to the second fuel plenum 108. As shown in FIG. 7, at least one of an airfoil 114 or vane may surround at least a portion of the second fuel conduit 112 in the annular passage 98 to reduce flow resistance of the working fluid flowing across the second fuel conduit 112 in the annular passage 98. In particular embodiments, the airfoil 114 or vane may be angled to impart swirl to the working fluid flowing through the annular passage 98.

In the particular embodiment shown in FIG. 7, a shroud 116 circumferentially surrounds the first fuel conduit 110 to define an annular passage 118 between the shroud 116 and the first fuel conduit 110. One or more swirler vanes 120 may be located between the shroud 116 and the first fuel conduit 110 to impart swirl to the working fluid flowing through the annular passage 118. In addition, the first fuel conduit 110 may extend radially inside the swirler vanes 120 and across the annular passage 118. In this manner, the first fuel conduit 110 may provide fluid communication through the swirler vanes 120 to the first fuel plenum 106 and/or the annular passage 118.

As in the previous embodiments, one or more of the premixer tubes 88 in each set may include a fuel port 122 that provides fluid communication through the premixer tubes 88 from the associated fuel plenum 106, 108. The fuel ports 122 may be angled radially, axially, and/or azimuthally to project and/or impart swirl to the fuel flowing through the fuel ports 122 and into the premixer tubes 88. In this manner, the working fluid may flow outside the end cap 86 through the annular passage 98 until it reaches the end cover 84 and reverses direction to flow through the first and second sets 102, 104 of premixer tubes 88 and the annular passage 118 surrounding the first fuel conduit 110. In addition, fuel from the first fuel conduit 110 may flow around the first set 102 of premixer tubes 88 in the first fuel plenum 106 to provide convective cooling to the premixer tubes 88 before flowing through the fuel ports 122 and into the first set 102 of premixer tubes 88 to mix with the working fluid. Similarly, fuel from the second fuel conduit 112 may flow around the second set 104 of premixer tubes 88 to provide convective cooling to the second set 104 of premixer tubes 88 before flowing through the fuel ports 122 and into the second set 104 of premixer tubes 88 to mix with the working fluid. If desired, the first fuel conduit 110 may also supply fuel through the swirler vanes 120 to mix with working fluid flowing through the annular passage 118. The fuel-working fluid mixture from each set 102, 104 of premixer tubes 88 and the annular passage 118 may then flow into the combustion chamber 94.

The end cap 86 may further include one or more expansion joints or bellows between the upstream and downstream surfaces 90, 92 to allow for thermal expansion of the premixer tubes 88 and shroud 116 between the upstream and downstream surfaces 90, 92. For example, as shown in FIG. 7, expansion joints 124 in the shroud 116, baffle 100, and/or cap shield 96 may allow for axial displacement of the upstream and downstream surfaces 90, 92 as the premixer tubes 88 and shroud 116 expand and contract. One or ordinary skill in the art will readily appreciate that alternate locations and/or combinations of expansion joints between the upstream and downstream surfaces 90, 92 are within the scope of various embodiments of the present invention, and the specific location or number of expansion joints is not a limitation of the present invention unless specifically recited in the claims.

Figure 8:
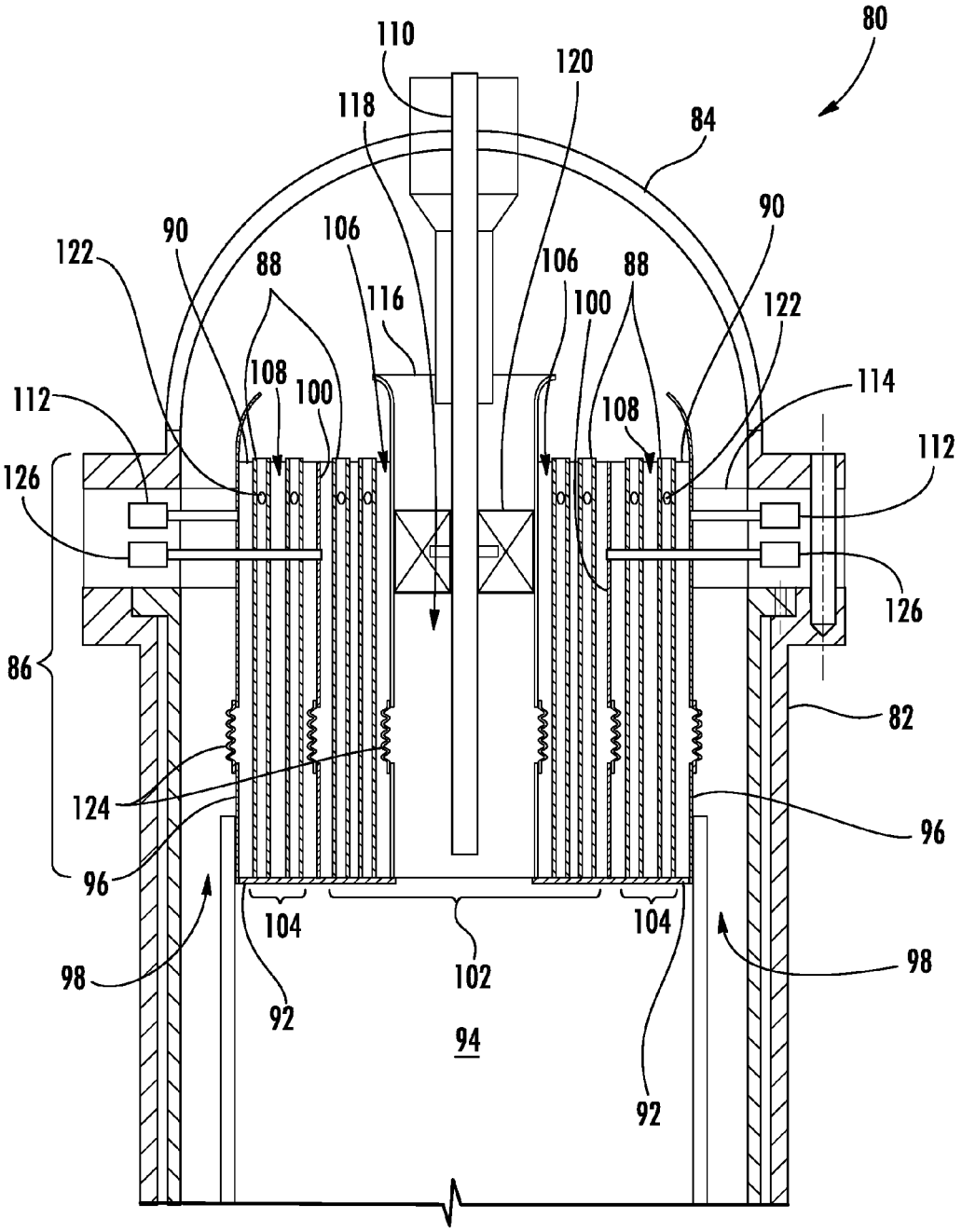
FIG. 8 is an enlarged cross-section view of an exemplary combustor according to a fourth embodiment of the present invention.

FIG. 8 provides an enlarged cross-section view of the combustor 80 shown in FIG. 7 according to a fourth embodiment of the present invention. As shown, the combustor 80 generally includes the same components as previously described with respect to the embodiment shown in FIG. 7. In this particular embodiment, the first fuel conduit 110 may again extend radially inside the swirler vanes 120 to provide fluid communication to the annular passage 118; however, the first fuel conduit 110 does not necessarily extend to the first fuel plenum 106. Instead, a third fuel conduit 126 may extend radially through the casing 82, annular passage 98, and cap shield 96 to provide fluid communication through the casing 82, annular passage 98, and cap shield 96 to the first fuel plenum 106. In this manner, the first fuel conduit 110 may supply fuel to the annular passage 118, the second fuel conduit 112 may supply the same or a different fuel to the second fuel plenum 108, and the third fuel conduit 126 may supply yet another or the same fuel to the first fuel plenum 106.

The various embodiments shown in FIGS. 1-8 provide multiple combinations of methods for supplying fuel to the combustor 80. For example, referring to the embodiment shown in FIG. 8, the working fluid may be supplied through the first and second sets 102, 104 of premixer tubes 88 and/or the annular passage 118. A first fuel may be supplied through the first fuel conduit 110 to the annular passage 118. Alternately, or in addition, a second fuel may be supplied through the second fuel conduit 112 to the second set 104 of premixer tubes 88 and/or directly into the working fluid flowing through the annular passage 44, as described with respect to the embodiment shown in FIG. 5. Still further, a third fuel may be supplied through the third fuel conduit 126 to the first set 102 of premixer tubes 88. Each embodiment thus provides very flexible methods for providing staged fueling to various locations across the combustor 80 to enable the combustor to operate over a wide range of operating conditions without exceeding design margins associated with flashback, flame holding, and/or emissions limits.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. an end cap that extends radially across at least a portion of the combustor, wherein the end cap comprises an upstream surface axially separated from a downstream surface and a cap shield circumferentially surrounding the upstream and downstream surfaces;

b. a first set of premixer tubes extending from the upstream surface through the downstream surface to provide fluid communication through the end cap;

c. a first fuel conduit in fluid communication with the first set of premixer tubes to supply fuel to the first set of premixer tubes;

d. a second set of premixer tubes extending from the upstream surface through the downstream surface to provide fluid communication through the end cap;

e. a casing circumferentially surrounding at least a portion of the cap shield to define an annular passage between the cap shield and the casing;

f. a second fuel conduit in fluid communication with the second set of premixer tubes to supply fuel through the annular passage to the second set of premixer tubes g. a barrier disposed between the upstream and downstream surfaces, wherein the barrier at least partially defines a fuel plenum and an air plenum inside the end cap; and h. a divider disposed within the end cap separating fuel flows to the first and second sets of premix tubes.

2. The combustor as in claim 1, wherein the first fuel conduit supplies fuel through the annular passage to the first set of premixer tubes.

3. The combustor as in claim 1, wherein the second set of premixer tubes surrounds the first set of premixer tubes.

4. The combustor as in claim 1, further comprising an expansion joint between the upstream and downstream surfaces.

5. The combustor as in claim 1, further comprising at least one of an airfoil or vane surrounding at least a portion of the second fuel conduit in the annular passage.

6. The combustor as in claim 1, further comprising an air port through the cap shield, wherein the air port provides fluid communication from the annular passage, through the cap shield, and into the air plenum.

7. The combustor as in claim 1, further comprising a shroud circumferentially surrounding the first fuel conduit, wherein the shroud provides fluid communication through the end cap.

8. The combustor as in claim 7, further comprising a swirler vane between the shroud and the first fuel conduit.

9. A combustor, comprising:

a. an end cap that extends radially across at least a portion of the combustor, wherein the end cap comprises an upstream surface axially separated from a downstream surface and a cap shield circumferentially surrounding the upstream and downstream surfaces;

b. a first fuel conduit in fluid communication with the end cap;

c. a first set of premixer tubes extending from the upstream surface through the downstream surface to provide fluid communication through the end cap;

d. a second set of premixer tubes extending from the upstream surface through the downstream surface to provide fluid communication through the end cap;

e. a casing circumferentially surrounding at least a portion of the end cap to define an annular passage between the end cap and the casing;

f. a second fuel conduit in fluid communication with the second set of premixer tubes to supply fuel through the annular passage to the second set of premixer tubes g. a barrier disposed between the upstream and downstream surfaces, wherein the barrier at least partially defines a fuel plenum and an air plenum inside the end cap; and h. a divider disposed within the end cap separating fuel flows to the first and second sets of premix tubes.

10. The combustor as in claim 9, wherein the first fuel conduit supplies fuel to the first set of premixer tubes.

11. The combustor as in claim 9, wherein the second set of premixer tubes surrounds the first set of premixer tubes.

12. The combustor as in claim 9, further comprising at least one of an airfoil or vane surrounding the second fuel conduit in the annular passage.

13. The combustor as in claim 9, further comprising an expansion joint between the upstream and downstream surfaces.

14. The combustor as in claim 9, further comprising a third fuel conduit in fluid communication with the first set of premixer tubes, wherein the third fuel conduit supplies fuel through the annular passage to the first set of premixer tubes.

15. The combustor as in claim 9, further comprising an air port through the cap shield, wherein the air port provides fluid communication from the annular passage, through the cap shield, and into the air plenum.

16. The combustor as in claim 9, further comprising a shroud circumferentially surrounding the first fuel conduit, wherein the shroud provides fluid communication through the end cap.

* * * * *